US012622528B2

(12) United States Patent
Chen et al.

(10) Patent No.: US 12,622,528 B2
(45) Date of Patent: May 12, 2026

(54) SELF-LOCKING MECHANISM AND FOLDING SOFA

(71) Applicant: JIAXING REST FURNITURE & APPLIANCE CO., LTD., Jiaxing (CN)

(72) Inventors: Jiguan Chen, Jiaxing (CN); Bin Chen, Jiaxing (CN); Qiangqiang Wu, Jiaxing (CN); Baoli Zhang, Jiaxing (CN); Chong Ma, Jiaxing (CN)

(73) Assignee: JIAXING REST FURNITURE & APPLIANCE CO., LTD., Jiaxing (CN)

( * ) Notice: Subject to any disclaimer, the term of this patent is extended or adjusted under 35 U.S.C. 154(b) by 30 days.

(21) Appl. No.: 18/661,752

(22) Filed: May 13, 2024

(65) Prior Publication Data

US 2025/0072623 A1 Mar. 6, 2025

(30) Foreign Application Priority Data

Sep. 6, 2023 (CN) ..... 202322418702.9

(51) Int. Cl.
*A47C 17/22* (2006.01)
*A47C 17/86* (2006.01)

(52) U.S. Cl.
CPC ..... *A47C 17/225* (2013.01); *A47C 17/86* (2013.01)

(58) Field of Classification Search
CPC ..... A47C 17/86; A47C 17/04; A47C 17/225; A47C 19/12; A47C 17/13; A47C 17/1756; A47C 17/165; A47C 1/0355; A47C 17/134; A47C 17/162; A47C 17/20; A47C 19/005; A47C 19/024; A47C 19/025; A47C 17/22; A47C 17/2073; A47C 19/027; A47C 19/122; A47C 19/22; A47C 20/048
USPC ..... 105/321; 5/12.1, 37.1, 41, 47, 55.1, 9.1
See application file for complete search history.

(56) References Cited

U.S. PATENT DOCUMENTS 9,609,955 B1 * 4/2017 Rogers ..... A47C 17/16

FOREIGN PATENT DOCUMENTS

CN 211559464 U * 9/2020
CN 212325947 U * 1/2021
CN 216059908 U * 3/2022 ..... A47C 17/165

* cited by examiner

*Primary Examiner* — Madison Rose Matthews
(74) *Attorney, Agent, or Firm* — Bayramoglu Law Offices LLC

(57) ABSTRACT

A self-locking mechanism and a folding sofa are provided. The self-locking mechanism includes a support member, a locking member, a drive member and a switch member. The support member has a first end and a second end opposite to each other. The locking member has a first connection portion and a locking portion, and the first connection portion of the locking member is pivotally connected to the first end of the support member. One end of the drive member is pivotally connected to the first connection portion of the locking member. The switch member has a second connection portion and a switch portion, where the second connection portion of the switch member is pivotally connected to the second end of the support member and the other end of the drive member.

16 Claims, 5 Drawing Sheets

SELF-LOCKING MECHANISM AND FOLDING SOFA

CROSS-REFERENCE TO THE RELATED APPLICATIONS

This application is based upon and claims priority to Chinese Patent Application No. 202322418702.9, filed on Sep. 6, 2023, the entire contents of which are incorporated herein by reference.

TECHNICAL FIELD

This application relates to a sofa, and particularly relates to a self-locking mechanism and a folding sofa.

BACKGROUND

Bed is one of the essential household items in people's home life. However, the bed usually occupies a large area and often occupy a considerable living space. To improve the reasonable use area, people improve the use mode of the bed to obtain more space to move around. Therefore, the folding sofa bed industry came into being.

In the process of implementing this application, the applicant found that some folding sofa beds at present may cause customers to make misoperation due to the soft package design problems of a sofa when unfolding the folding sofa, which may lead to the damage of bedstead parts.

SUMMARY

An embodiment of this application provides a self-locking mechanism and a folding sofa, which solve the problem that the folding sofa is opened by misoperation. To solve the above technical problem, this application is implemented as follows:

In a first aspect, a self-locking mechanism is provided, which is configured to automatically lock a folding bedstead of a folding sofa, and includes a support member, a locking member, a drive member and a switch member. The support member has a first end and a second end opposite to each other. The locking member has a first connection portion and a locking portion, and the first connection portion of the locking member is pivotally connected to the first end of the support member. One end of the drive member is pivotally connected to the first connection portion of the locking member. The switch member has a second connection portion and a switch portion, the second connection portion of the switch member is pivotally connected to the second end of the support member and the other end of the drive member, and the switch portion drives the locking portion to rotate downwards and be pressed against the folding bedstead to lock the folding bedstead.

In a second aspect, a folding sofa is provided, which includes a sofa body frame, a folding bedstead and the self-locking mechanism according to any of the above first aspect. The self-locking mechanism and the folding bedstead are arranged on the sofa body frame. The folding bedstead can be folded or unfolded on the sofa body frame. When the folding bedstead is folded on the sofa body frame, the folding bedstead pushes the switch portion to rotate downwards, and the switch portion drives the locking portion to rotate downwards, so that the locking portion is pressed against the folding bedstead to lock the folding bedstead.

In the embodiment of this application, the switch portion is driven to rotate downwards by a folding action of the folding bedstead, so that the locking portion is driven to rotate downwards and pressed against the folding bedstead to lock the folding bedstead, and thus the folding bedstead can be prevented from being opened by misoperation. In addition, after the folding bedstead is unfolded, the self-locking mechanism can also be used as a support to support the folding bedstead to a fixed position. Meanwhile, the self-locking mechanisms can be separately sent to customers for use, and can be used as additional options for the folding sofas according to customer needs, and the customers only need to install them in corresponding positions as required.

BRIEF DESCRIPTION OF THE DRAWINGS

The accompanying drawings described herein are used to provide a further understanding of this application, and form part of this application. Exemplary embodiments of this application and descriptions thereof are used to explain this application, and do not constitute any inappropriate limitation to this application. In the accompanying drawings.

With the accompanying drawings, it is explained as follows:

100: self-locking mechanism; 1: support member; 11: first end; 111: pivoting portion; 12: second end; 121: horizontal plate; 122: vertical plate; 13: middle section; 2: locking member; 21: first connection portion; 22: locking portion; 23: first connection shaft; 3: drive member; 31: third connection shaft; 4: switch member; 41: second connection portion; 42: switch portion; 43: second connection shaft; 5: elastic member; 6: fastener; 200: folding sofa; 201: folding bedstead; and 202: sofa body frame.

DETAILED DESCRIPTION OF THE EMBODIMENTS

The technical solutions in embodiments of this application are clearly and completely described in the following with reference to the accompanying drawings in the embodiments of this application. Apparently, the described embodiments are merely some rather than all of the embodiments of this application. All other embodiments obtained by a person of ordinary skill in the art based on the embodiments of this application without making creative efforts shall fall within the protection scope of this application.

In the description of this application, it should be understood that orientation or position relationships indicated by the terms such as "upper", "lower", "vertical", "horizontal", "top", "bottom", "inside", and "outside" are based on orientation or position relationships shown in the accompanying drawings, and are used only for ease and brevity of illustration and description, rather than indicating or implying that the mentioned apparatus or component must have a particular orientation or must be constructed and operated in a particular orientation. Therefore, such terms should not be construed as limiting of this application.

In addition, the terms such as "first" and "second" used herein do not specifically refer to the order or sequence, nor are they used to limit this application, but only to distinguish assemblies or operations described in the same technical terms.

Figure 1:
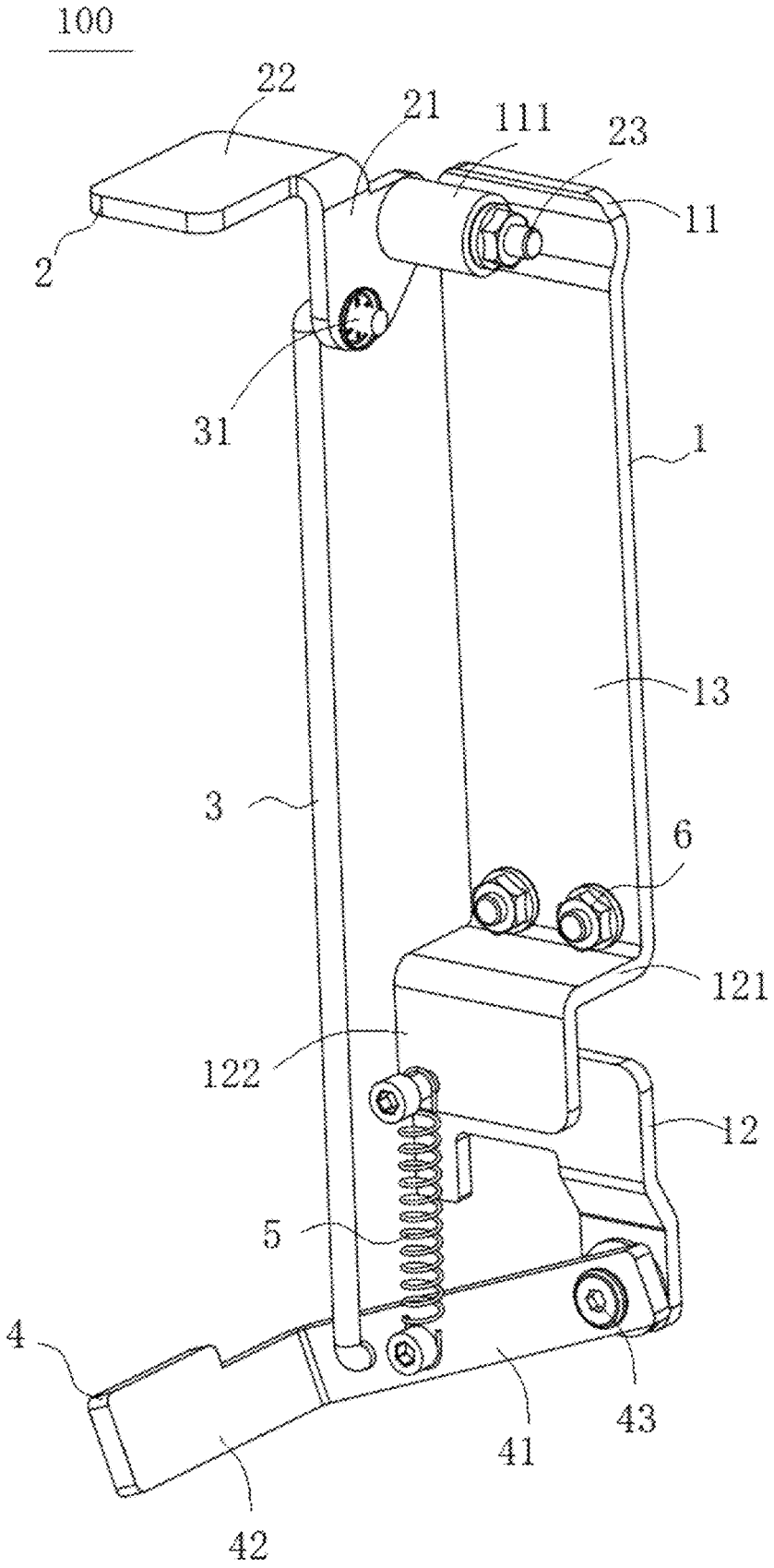
FIG. 1 is a schematic diagram of a self-locking mechanism in a locking state of an embodiment of this application.
Figure 2:
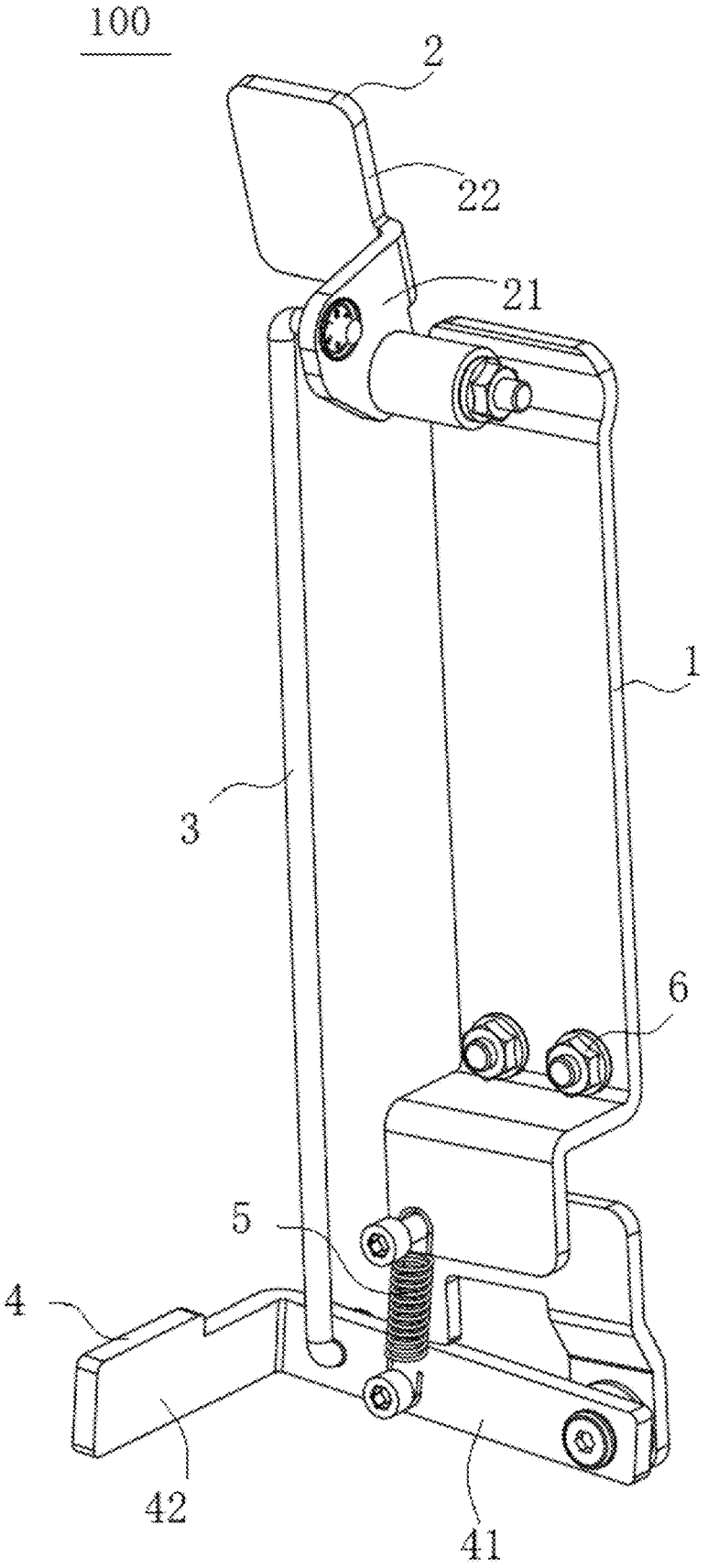
FIG. 2 is a schematic diagram of a self-locking mechanism in an opening state of an embodiment of this application.
Figure 3:
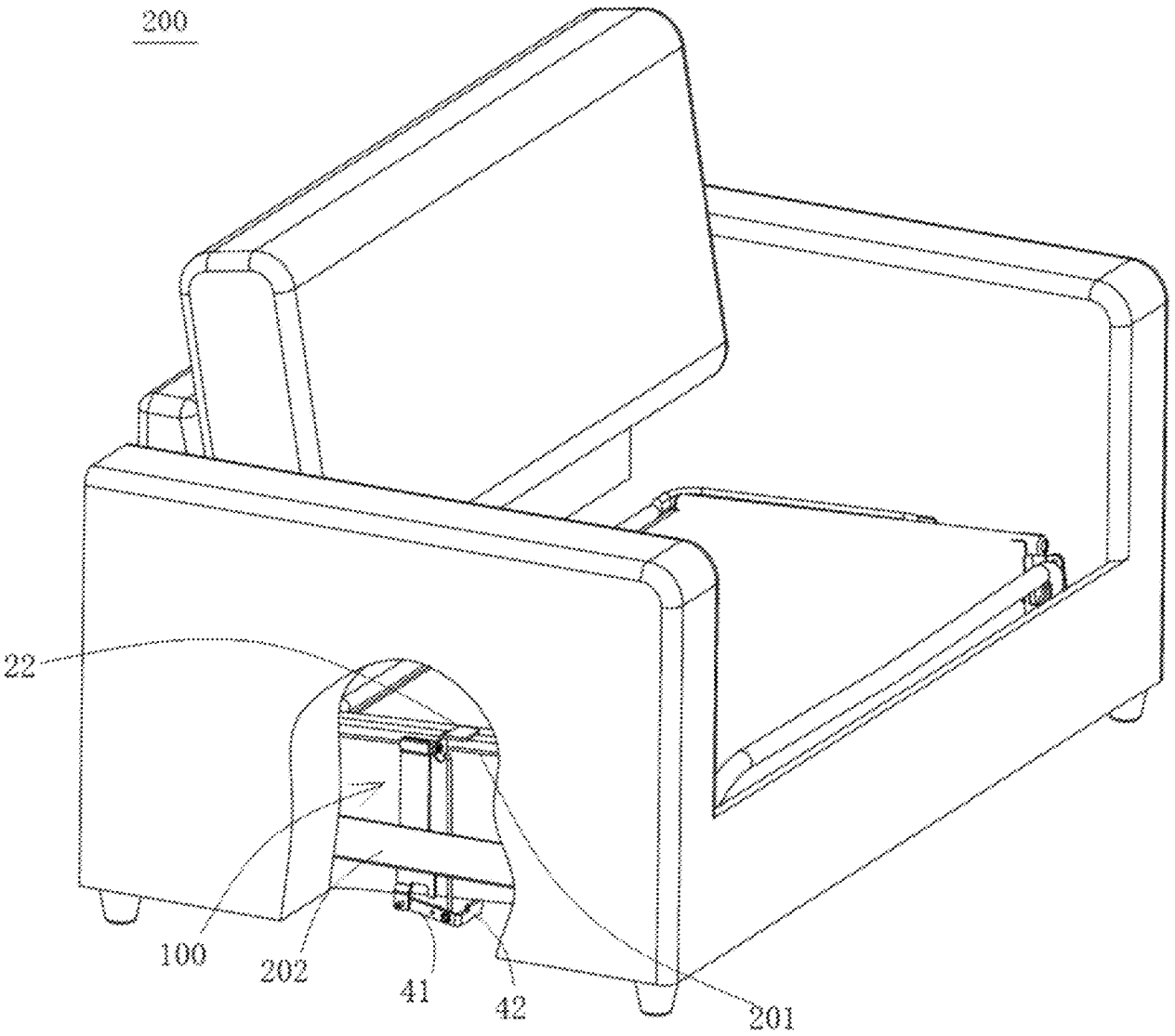
FIG. 3 is a stereogram of a folding sofa in a folded state of an embodiment of this application.

Please refer to FIG. 1 to FIG. 3, FIG. 1 and FIG. 2 are schematic diagrams of a self-locking mechanism in a locking state and an opening state of an embodiment of this application, and FIG. 3 is a stereographic diagram of a folding sofa in a folded state of an embodiment of this application; as shown in the figures, the self-locking mechanism 100 is configured to automatically lock a folding bedstead 201 of a folding sofa 200. The self-locking mechanism 100 of this embodiment includes a support member 1, a locking member 2, a drive member 3 and a switch member 4. The support member 1 has a first end 11 and a second end 12 opposite to each other. In this embodiment, a middle section 13 between the first end 11 and the second end 12 is a rectangular steel plate. As shown in FIG. 1, the support member 1 is perpendicularly arranged, the first end 11 is located at the upper end of the support member 1, and the second end 12 is located at the lower end of the support member 1.

The locking member 2 has a first connection portion 21 and a locking portion 22. The first connection portion 21 of the locking member 2 is pivotally connected to the first end of 11 the support member 1. In this embodiment, the support member 1 has a pivoting portion 111 at the first end 11, and the first connection portion 21 of the locking member 2 penetrates through the pivoting portion 111 through a first connection shaft 23, to be pivotally connected to the first end 11 of the support member 1. The first connection portion 21 may use an angular plate, the locking portion 22 may use a rectangular plate, and the pivoting portion 111 may use a bearing.

One end of the drive member 3 is pivotally connected to the first connection portion 21 of the locking member 2. The switch member 4 has a second connection portion 41 and a switch portion 42. The other end of the drive member 3 is pivotally connected to the second connection portion 41 of the switch member 4. The drive member 3 may be respectively pivotally connected to the locking member 2 and the switch member 4 by third connection shafts 31 penetrating through the two ends of the drive member, the first connection portion 21 of the locking member 2 and the second connection portion 41 of the switch member 4. In this embodiment, the drive member 3 uses a connecting rod.

As mentioned above, the second connection portion 41 of the switch member 4 is further pivotally connected to the second end 12 of the support member 1. The switch member 4 may be pivotally connected to the support member 1 by a second connection shaft 43 penetrating through the second connection portion 41 and the second end 12 of the support member 1. The switch portion 42 drives the locking portion 22 to rotate downwards and be pressed against the folding bedstead 201 to lock the folding bedstead 201. In this embodiment, the switch member 4 uses an L-shaped rod, in other words, the second connection portion 41 and the switch portion 42 form an L-shaped rod.

Refer to FIG. 1 to FIG. 3 again, when the self-locking mechanism 100 of this embodiment is in use, the second connection portion 41 is driven to rotate downwards by rotating the switch portion 42 downwards, and meanwhile, the second connection portion 41 drives the first connection portion 21 to rotate downwards through the drive member 3, so as to drive the locking portion 22 to rotate downwards and thus in a locking state; conversely, the locking portion 22 can be driven to rotate upwards by rotating the switch portion 42 upwards, and thus in an opening state. When the self-locking mechanism 100 of this embodiment is applied to the folding sofa 200, the switch portion 42 drives the locking portion 22 to rotate downwards and be pressed against the folding bedstead 201 to lock the folding bedstead 201, so that the folding bedstead 201 can be prevented from being opened by misoperation. In addition, after the folding bedstead 201 is unfolded, the self-locking mechanism 100 can also be used as a support to support the folding bedstead 201 to a fixed position. Meanwhile, the self-locking mechanisms 100 of this embodiment can be separately sent to customers for use, and can be used as additional options for the folding sofas 200 according to customer needs, and the customers only need to install them in corresponding positions as required.

Figure 4:
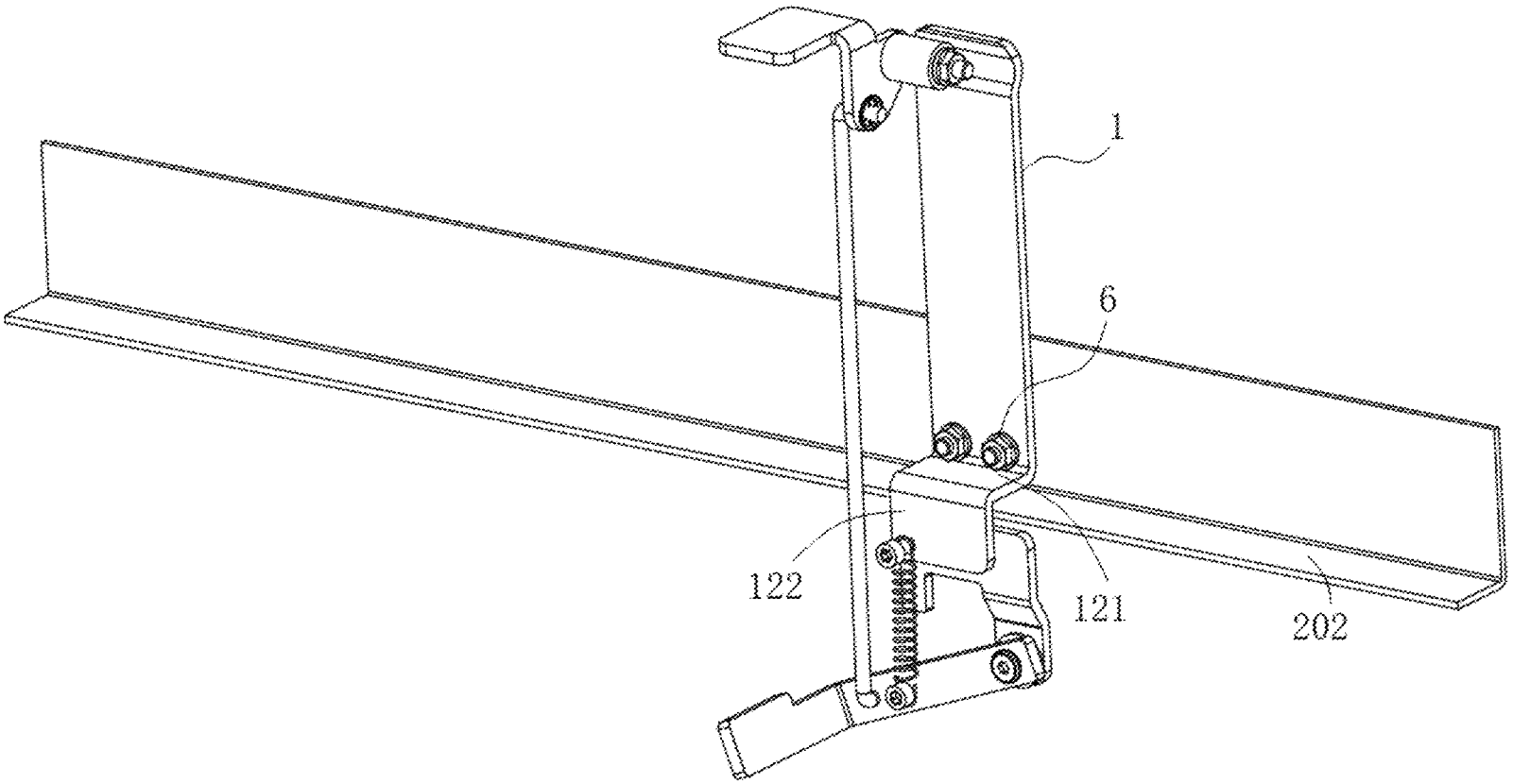
FIG. 4 is a partial schematic diagram of FIG. 3 of this application.

Please refer to FIG. 4 together with FIG. 1, FIG. 4 is a partial schematic diagram of FIG. 3 of this application; as shown in the figures, the support member 1 has a horizontal plate 121 and a vertical plate 122 at the second end 12. One end of the horizontal plate 121 is perpendicularly connected to the middle section 13 between the first end 11 and the second end 12 of the support member 1. The other end of the horizontal plate 121 is perpendicularly connected to the vertical plate 122 and extends downwards, and the horizontal plate 121 is installed on the sofa body frame 202 of the folding sofa 200.

Please refer to FIG. 1 and FIG. 2 again, the self-locking mechanism 100 further includes an elastic member 5. One end of the elastic member 5 is connected to the second end 12 of support member 1, and the other end of the elastic member 5 is connected to the second connection portion 41 of the switch member 4. When the locking portion 22 is in a locking state, the elastic member 5 is in a stretching state, so that the locking portion 22 has a tendency to move to an opening state, which is convenient for opening of the self-locking mechanism 100/unfolding of the folding bedstead 201. In this embodiment, the elastic member 5 uses a tension spring.

Please refer to FIG. 3 and FIG. 4 again, the self-locking mechanism 100 further includes fasteners 6. The fasteners 6 are configured to connect the support member 1 and the sofa body frame 202 of the folding sofa 200, to fix the self-locking mechanism 100 to the folding sofa 200. In this embodiment, the fasteners 6 use rivets.

Figure 5:
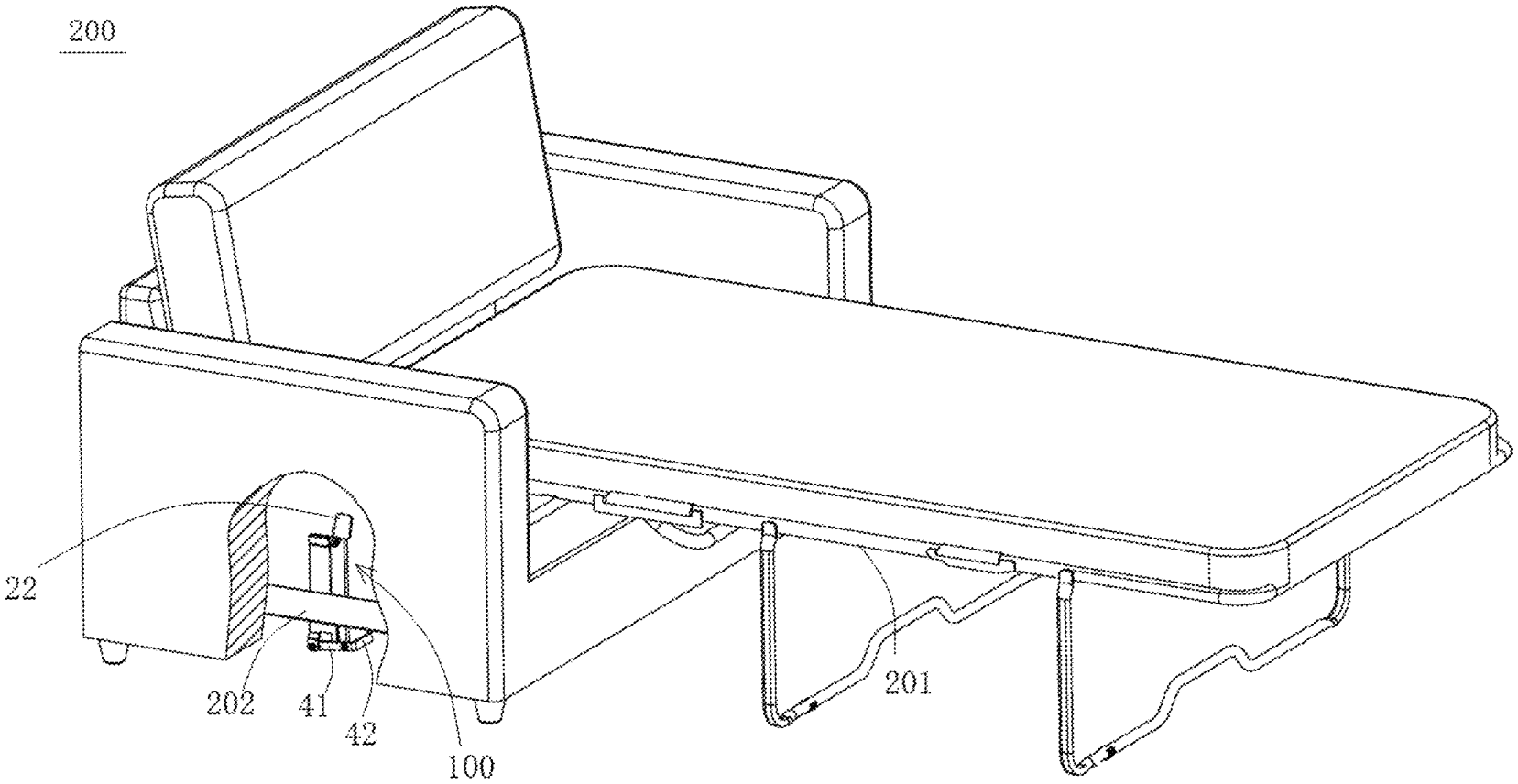
FIG. 5 is a stereogram of a folding sofa in an unfolded state of an embodiment of this application.

Please refer to FIG. 5 together with FIG. 3, FIG. 5 is a stereographic diagram of a folding sofa in an unfolded state of an embodiment of this application; as shown in the figures, the folding sofa 200 includes the above self-locking mechanism 100, the folding bedstead 201 and the sofa body frame 202. The self-locking mechanism 100 and the folding bedstead 201 are arranged on the sofa body frame 202. The folding bedstead 201 can be folded or unfolded on the sofa body frame 202. In this embodiment, the horizontal plate 121 of the self-locking mechanism 100 is installed on the sofa body frame 202 of the folding sofa 200, and is connected to the support member 1 and the sofa body frame 202 of the folding sofa 200 through the fasteners 6.

When the folding bedstead 201 is folded on the sofa body frame 202, the folding bedstead 201 pushes the switch portion 42 to rotate downwards, and the switch portion 42 drives the locking portion 22 to rotate downwards, so that the locking portion 22 is pressed against the folding bedstead 201 to lock the folding bedstead 201, and thus the folding bedstead 201 can be prevented from being opened by misoperation. When the folding bedstead 201 is unfolded according to normal steps, the self-locking mechanism 100 may be unlocked automatically, at this time, the self-locking mechanism can also be used as a support to support the folding bedstead 201 to the fixed position.

In conclusion, this application discloses the self-locking mechanism and the folding sofa. According to this application, the switch portion is driven to rotate downwards by a folding action of the folding bedstead, so that the locking portion is driven to rotate downwards and pressed against the folding bedstead to lock the folding bedstead, and thus the folding bedstead can be prevented from being opened by mistake. In addition, after the folding bedstead is unfolded, the self-locking mechanism can also be used as a support to support the folding bedstead to a fixed position. Meanwhile, the self-locking mechanisms can be separately sent to customers for use, and can be used as additional options for the folding sofas according to customer needs, and the customers only need to install them in corresponding positions as required.

It should be noted that the term herein "include," "comprise," or their any other variants is intended to cover a non-exclusive inclusion, so that a process, a method, an article, or an apparatus that includes a series of elements not only includes such elements, but also includes other elements not expressly listed, or further includes elements inherent to such a process, method, article, or apparatus. If there are no more limitations, an element limited by "include a/an . . . " does not exclude other same elements existing in the process, the method, the article, or the apparatus which includes the element.

The embodiments of this application are described with reference to the accompanying drawings. However, this application is not limited to the foregoing specific implementations. The foregoing specific implementations are merely exemplary, but are not restrictive. Persons of ordinary skill in the art may make many forms without departing from the object and the scope of the claims of this application and are within the protection scope of this application.

What is claimed is:

1. A self-locking mechanism, configured to automatically lock a folding bedstead of a folding sofa, comprising: a support member, wherein the support member has a first end and a second end opposite to each other; a locking member, wherein the locking member has a first connection portion and a locking portion, the first connection portion of the locking member is pivotally connected to the first end of the support member; a drive member, wherein a first end of the drive member is pivotally connected to the first connection portion of the locking member; a switch member, wherein the switch member has a second connection portion and a switch portion, the second connection portion of the switch member is pivotally connected to the second end of the support member and a second end of the drive member, and the switch portion is configured to drive the locking portion to rotate downwards and be pressed against the folding bedstead to lock the folding bedstead; and an elastic member, wherein a first end of the elastic member is connected to the second end of the support member, a second end of the elastic member is connected to the second connection portion of the switch member, and when the locking portion is in a locking state, the elastic member is in a stretching state.

2. The self-locking mechanism according to claim 1, wherein the elastic member uses a tension spring.

3. The folding sofa, comprising: a sofa body frame, the folding bedstead and the self-locking mechanism according to claim 2, wherein the self-locking mechanism and the folding bedstead are arranged on the sofa body frame, the folding bedstead is allowed to be folded or unfolded on the sofa body frame, when the folding bedstead is folded on the sofa body frame, the folding bedstead pushes the switch portion to rotate downwards, and the switch portion is configured to drive the locking portion to rotate downwards, wherein the locking portion is pressed against the folding bedstead to lock the folding bedstead.

4. The self-locking mechanism according to claim 1, further comprising: fasteners, configured to connect the support member and a sofa body frame of the folding sofa, to fix the self-locking mechanism to the folding sofa.

5. The folding sofa, comprising: a sofa body frame, the folding bedstead and the self-locking mechanism according to claim 4, wherein the self-locking mechanism and the folding bedstead are arranged on the sofa body frame, the folding bedstead is allowed to be folded or unfolded on the sofa body frame, when the folding bedstead is folded on the sofa body frame, the folding bedstead pushes the switch portion to rotate downwards, and the switch portion is configured to drive the locking portion to rotate downwards, wherein the locking portion is pressed against the folding bedstead to lock the folding bedstead.

6. The self-locking mechanism according to claim 4, wherein the fasteners use rivets.

7. The folding sofa, comprising: a sofa body frame, the folding bedstead and the self-locking mechanism according to claim 6, wherein the self-locking mechanism and the folding bedstead are arranged on the sofa body frame, the folding bedstead is allowed to be folded or unfolded on the sofa body frame, when the folding bedstead is folded on the sofa body frame, the folding bedstead pushes the switch portion to rotate downwards, and the switch portion is configured to drive the locking portion to rotate downwards, wherein the locking portion is pressed against the folding bedstead to lock the folding bedstead.

8. The self-locking mechanism according to claim 1, wherein the locking portion is a rectangular plate.

9. The folding sofa, comprising: a sofa body frame, the folding bedstead and the self-locking mechanism according to claim 8, wherein the self-locking mechanism and the folding bedstead are arranged on the sofa body frame, the folding bedstead is allowed to be folded or unfolded on the sofa body frame, when the folding bedstead is folded on the sofa body frame, the folding bedstead pushes the switch portion to rotate downwards, and the switch portion is configured to drive the locking portion to rotate downwards, wherein the locking portion is pressed against the folding bedstead to lock the folding bedstead.

10. The self-locking mechanism according to claim 1, wherein the drive member uses a connecting rod.

11. The folding sofa, comprising: a sofa body frame, the folding bedstead and the self-locking mechanism according to claim 10, wherein the self-locking mechanism and the folding bedstead are arranged on the sofa body frame, the folding bedstead is allowed to be folded or unfolded on the sofa body frame, when the folding bedstead is folded on the sofa body frame, the folding bedstead pushes the switch portion to rotate downwards, and the switch portion is configured to drive the locking portion to rotate downwards, wherein the locking portion is pressed against the folding bedstead to lock the folding bedstead.

12. The self-locking mechanism according to claim 1, wherein the switch member uses an L-shaped rod.

13. The folding sofa, comprising: a sofa body frame, the folding bedstead and the self-locking mechanism according to claim 12, wherein the self-locking mechanism and the folding bedstead are arranged on the sofa body frame, the folding bedstead is allowed to be folded or unfolded on the sofa body frame, when the folding bedstead is folded on the sofa body frame, the folding bedstead pushes the switch portion to rotate downwards, and the switch portion is configured to drive the locking portion to rotate downwards, wherein the locking portion is pressed against the folding bedstead to lock the folding bedstead.

14. The folding sofa, comprising: a sofa body frame, the folding bedstead and the self-locking mechanism according to claim 1, wherein the self-locking mechanism and the folding bedstead are arranged on the sofa body frame, the folding bedstead is allowed to be folded or unfolded on the sofa body frame, when the folding bedstead is folded on the sofa body frame, the folding bedstead pushes the switch portion to rotate downwards, and the switch portion drives the locking portion to rotate downwards, wherein the locking portion is pressed against the folding bedstead to lock the folding bedstead.

15. A self-locking mechanism, configured to automatically lock a folding bedstead of a folding sofa, comprising: a support member, wherein the support member has a first end and a second end opposite to each other a locking member, wherein the locking member has a first connection portion and a locking portion, the first connection portion of the locking member is pivotally connected to the first end of the support member a drive member, wherein a first end of the drive member is pivotally connected to the first connection portion of the locking member a switch member, wherein the switch member has a second connection portion and a switch portion, the second connection portion of the switch member is pivotally connected to the second end of the support member and a second end of the drive member, and the switch portion is configured to drive the locking portion to rotate downwards and be pressed against the folding bedstead to lock the folding bedstead; wherein the support member has a horizontal plate and a vertical plate at the second end, a first end of the horizontal plate is perpendicularly connected to a middle section between the first end and the second end of the support member, a second end of the horizontal plate is perpendicularly connected to the vertical plate and extends downward, and the horizontal plate is installed on a sofa body frame of the folding sofa.

16. The folding sofa, comprising: a sofa body frame, the folding bedstead and the self-locking mechanism according to claim 15, wherein the self-locking mechanism and the folding bedstead are arranged on the sofa body frame, the folding bedstead is allowed to be folded or unfolded on the sofa body frame, when the folding bedstead is folded on the sofa body frame, the folding bedstead pushes the switch portion to rotate downwards, and the switch portion is configured to drive the locking portion to rotate downwards, wherein the locking portion is pressed against the folding bedstead to lock the folding bedstead.

* * * * *